US011738236B2

(12) United States Patent
Wang

(10) Patent No.: US 11,738,236 B2
(45) Date of Patent: Aug. 29, 2023

(54) PUSH-UP EXERCISE APPARATUS

(71) Applicant: BETO ENGINEERING AND MARKETING CO., LTD., Taichung (TW)

(72) Inventor: Lopin Wang, Taichung (TW)

(73) Assignee: BETO ENGINEERING AND MARKETING CO., LTD., Taichung (TW)

( * ) Notice: Subject to any disclaimer, the term of this patent is extended or adjusted under 35 U.S.C. 154(b) by 210 days.

(21) Appl. No.: 17/470,357

(22) Filed: Sep. 9, 2021

(65) Prior Publication Data

US 2022/0072368 A1 Mar. 10, 2022

(30) Foreign Application Priority Data

Sep. 10, 2020 (TW) ..... 109131087

(51) Int. Cl.
*A63B 23/12* (2006.01)
*A63B 23/035* (2006.01)
*A63B 21/00* (2006.01)

(52) U.S. Cl.
CPC ..... *A63B 23/1236* (2013.01); *A63B 21/4035* (2015.10); *A63B 23/03533* (2013.01); *A63B 2225/09* (2013.01)

(58) Field of Classification Search
CPC ..... A63B 21/068; A63B 21/4033; A63B 21/4035; A63B 21/4045; A63B 23/035; A63B 23/03516; A63B 23/03533; A63B 23/12; A63B 23/1209; A63B 23/1236; A63B 71/0054; A63B 2071/0072; A63B 2208/0295; A63B 2225/09
See application file for complete search history.

(56) References Cited

U.S. PATENT DOCUMENTS 2,543,729 A * 2/1951 Magida ..... A63B 21/0004 482/909
RE23,744 E * 11/1953 Magida ..... A63B 21/4047 403/120
2,725,232 A * 11/1955 Magida ..... A63B 21/015 403/162
4,374,588 A * 2/1983 Ruggles ..... A63B 23/03533 482/109

(Continued)

FOREIGN PATENT DOCUMENTS

GB 2566097 A * 3/2019 ..... A63B 57/00
WO WO-2007048020 A1 * 4/2007 ..... A63B 23/03575

*Primary Examiner* — Gary D Urbiel Goldner
(74) *Attorney, Agent, or Firm* — Muncy, Geissler, Olds & Lowe, P.C.

(57) ABSTRACT

A push-up exercise apparatus includes two base seats pivotable relative to each other about a vertical axis, and two handgrips respectively disposed on the base seats. Each base seat includes a connecting body. The connecting bodies of the base seats are disposed one above the other and are rotatable relative to each other about the vertical axis. A retaining mechanism includes a rotating cap rotatably disposed on an upper one of the connecting bodies, an elastic member disposed between the connecting bodies, and at least one retaining unit including first and second retaining members respectively disposed on the rotating cap and a lower connecting body and engaged with each other.

10 Claims, 7 Drawing Sheets

(56) References Cited

U.S. PATENT DOCUMENTS

| | | | | | |
|---|---|---|---|---|---|
| 4,465,276 | A * | 8/1984 | Cox | A63B 21/4035 | 482/126 |
| 4,846,465 | A * | 7/1989 | Iams | A63B 21/068 | 601/40 |
| 5,507,712 | A * | 4/1996 | Chang | A63B 21/4047 | 482/126 |
| 5,713,823 | A * | 2/1998 | Walendzak | A63B 22/18 | 482/141 |
| 6,139,476 | A * | 10/2000 | Gallant | A63B 21/157 | 482/114 |
| 7,828,704 | B1 * | 11/2010 | Hsieh | A63B 23/12 | 482/121 |
| 9,067,104 | B1 * | 6/2015 | Kim | A63B 22/20 | |
| 10,328,325 | B2 * | 6/2019 | Frugoli | A63B 69/0095 | |
| D904,535 | S * | 12/2020 | Li | A63B 21/4047 | D21/686 |
| 2010/0062913 | A1 * | 3/2010 | Splane | A63B 21/068 | 482/142 |
| 2010/0062914 | A1 * | 3/2010 | Splane | A63B 21/068 | 482/96 |
| 2014/0141949 | A1 * | 5/2014 | Mills | A63B 21/4045 | 482/140 |
| 2014/0162857 | A1 * | 6/2014 | Shade | A63B 22/205 | 482/141 |
| 2016/0310816 | A1 * | 10/2016 | Horne | A63B 23/03516 | |

* cited by examiner

PUSH-UP EXERCISE APPARATUS

CROSS-REFERENCE TO RELATED APPLICATION

This application claims priority to Taiwanese Patent Application No. 109131087, filed on Sep. 10, 2020.

FIELD

The disclosure relates to a training device that can promote or strengthen the muscles or joints of a human body, more particularly to a push-up exercise apparatus.

BACKGROUND

A conventional push-up exercise frame includes a base seat and two handgrips fixed to the base seat. The handgrips can be gripped by both hands of a user for performing a push-up exercise. However, the positions of the handgrips are fixed, so that the distance between the handgrips cannot be adjusted according to the body type of a user or the training intensity.

SUMMARY

Therefore, an object of the present disclosure is to provide an improved push-up exercise apparatus that can alleviate at least one of the drawbacks of the prior art.

According to this disclosure, a push-up exercise apparatus includes a base mechanism, a grip mechanism, and a retaining mechanism. The base mechanism includes two base seats pivotable relative to each other about a vertical axis. Each base seat includes a base seat main body, and a connecting body connected to a front side of the base seat main body. The connecting bodies of the base seats are disposed one above the other and are rotatable relative to each other about the vertical axis. The grip mechanism includes two handgrips respectively disposed on the base seats.

The retaining mechanism includes a rotating cap rotatably disposed on an upper one of the connecting bodies, a first elastic member disposed between the connecting bodies, and at least one retaining unit that includes a first retaining member and a second retaining member respectively disposed on the rotating cap and a lower one of the connecting bodies and engaged with each other. The rotating cap is rotated to drive the first retaining member to move relative to the second retaining member, thereby driving the connecting bodies toward and away from each other. The connecting bodies are engaged with each other when driven toward each other so as to fix the base seats in an angular position relative to each other.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
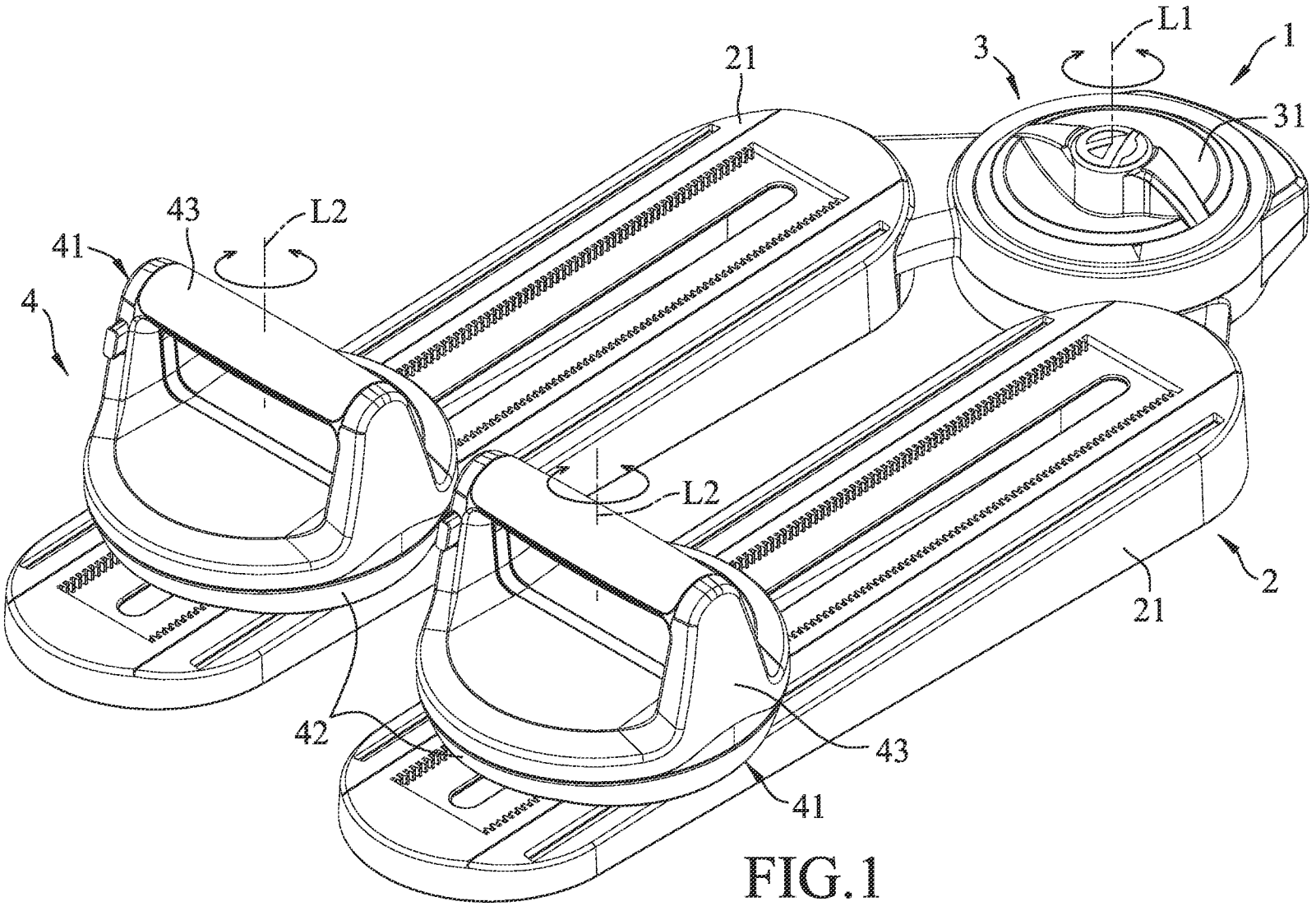
FIG. 1 is a perspective view of a push-up exercise apparatus according to an embodiment of the present disclosure.
Figure 2:
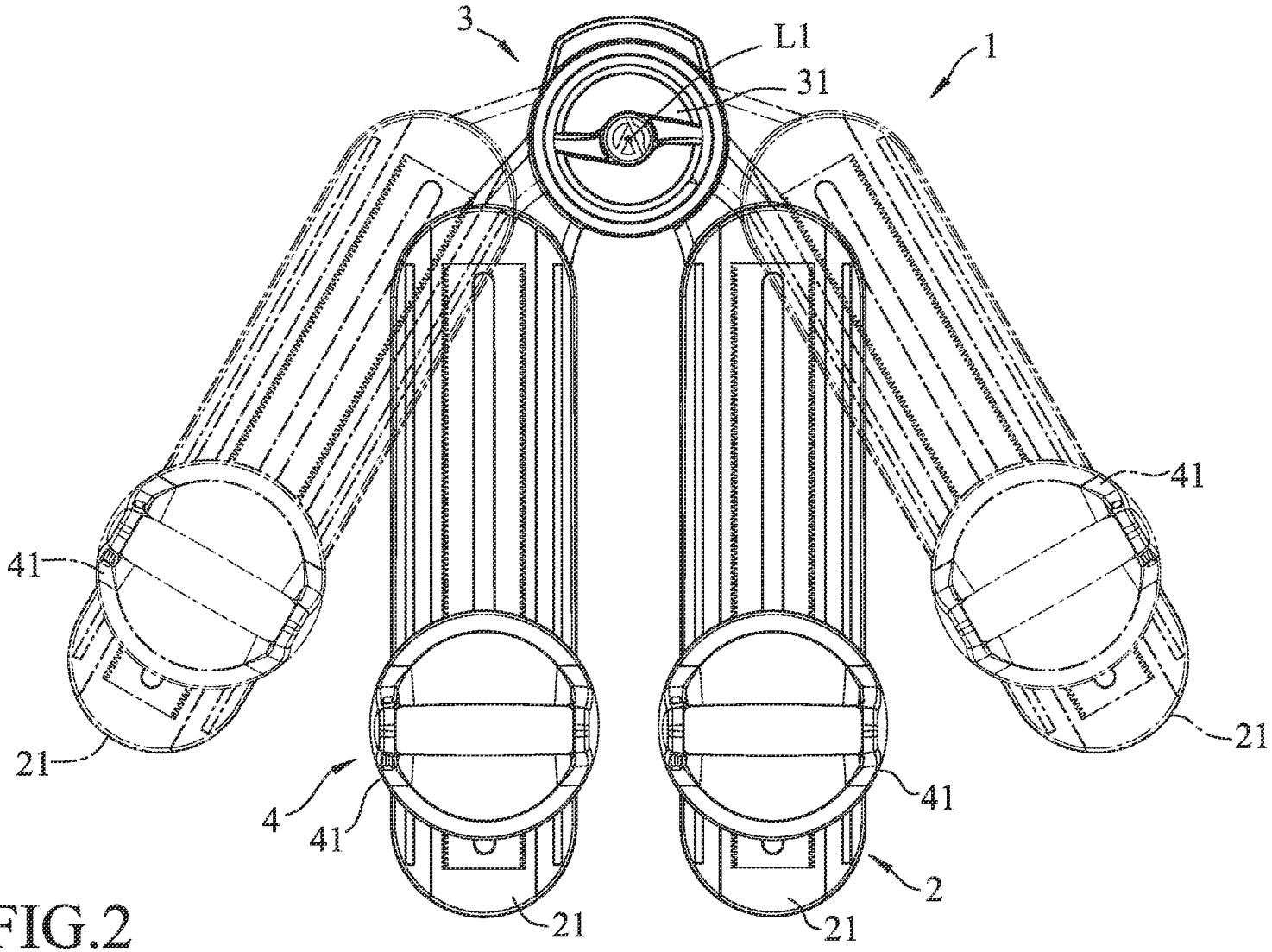
FIG. 2 is a top view of the embodiment, illustrating two base seats being pivotable relative to each other about a vertical axis.

Referring to FIGS. 1 to 4, a push-up exercise apparatus 1 according to an embodiment of the present disclosure includes a base mechanism 2, a retaining mechanism 3, and a grip mechanism 4.

The base mechanism 2 includes two base seats 21 pivotable relative to each other about a vertical axis (L1). Each base seat 21 includes an elongated base seat main body 22, and a connecting body 23 connected to a front side of the base seat main body 22. The base seat main body 22 has two spaced-apart positioning portions 221 extending along a length thereof. Each positioning portion 221 has a plurality of teeth 20 formed along a length thereof. The teeth 20 of the positioning portions 221 face each other. The connecting bodies 23 of the base seats 21 are disposed one above the other, are rotatable relative to each other about the vertical axis (L1), and have inner surfaces facing each other and respectively provided with a plurality of meshing teeth 231 surrounding the vertical axis (L1).

The retaining mechanism 3 includes a rotating cap 31 rotatably disposed on an upper one of the connecting bodies 23, a first elastic member 32 disposed between the connecting bodies 23, and four retaining units 33. The rotating cap 31 has an annular protrusion 311 extending axially and inwardly from a central portion thereof. Each retaining unit 33 includes a first retaining member 331 disposed on an outer peripheral edge of the annular protrusion 311, and a second retaining member 332 disposed on an inner peripheral surface of a lower one of the connecting bodies 23. The second retaining member 332 has a lower retaining surface 333 extending horizontally and facing downwardly, an inclined guide surface 334 that extends upwardly and inclinedly from the lower retaining surface 333 and that faces downwardly, and an upper retaining surface 335 that extends horizontally, that faces downwardly, that is connected to a top end of the inclined guide surface 334 and that is opposite to the lower retaining surface 333.

The first retaining members 331 of the retaining units 33 are angularly spaced apart from each other. The second retaining members 332 of the retaining units 33 are provided around the inner peripheral surface of the lower connecting body 23. The first retaining members 331 are respectively engaged with the second retaining members 332. The rotating cap 31 is rotated to drive the first retaining member 331 to move relative to the second retaining member 332, thereby driving the connecting bodies 23 toward and away from each other. When the first retaining member 331 moves from the upper retaining surface 335 to the lower retaining surface 333 along the inclined guide surface 334, the connecting bodies 23 are driven toward each other so as to interengage each other.

Figure 3:
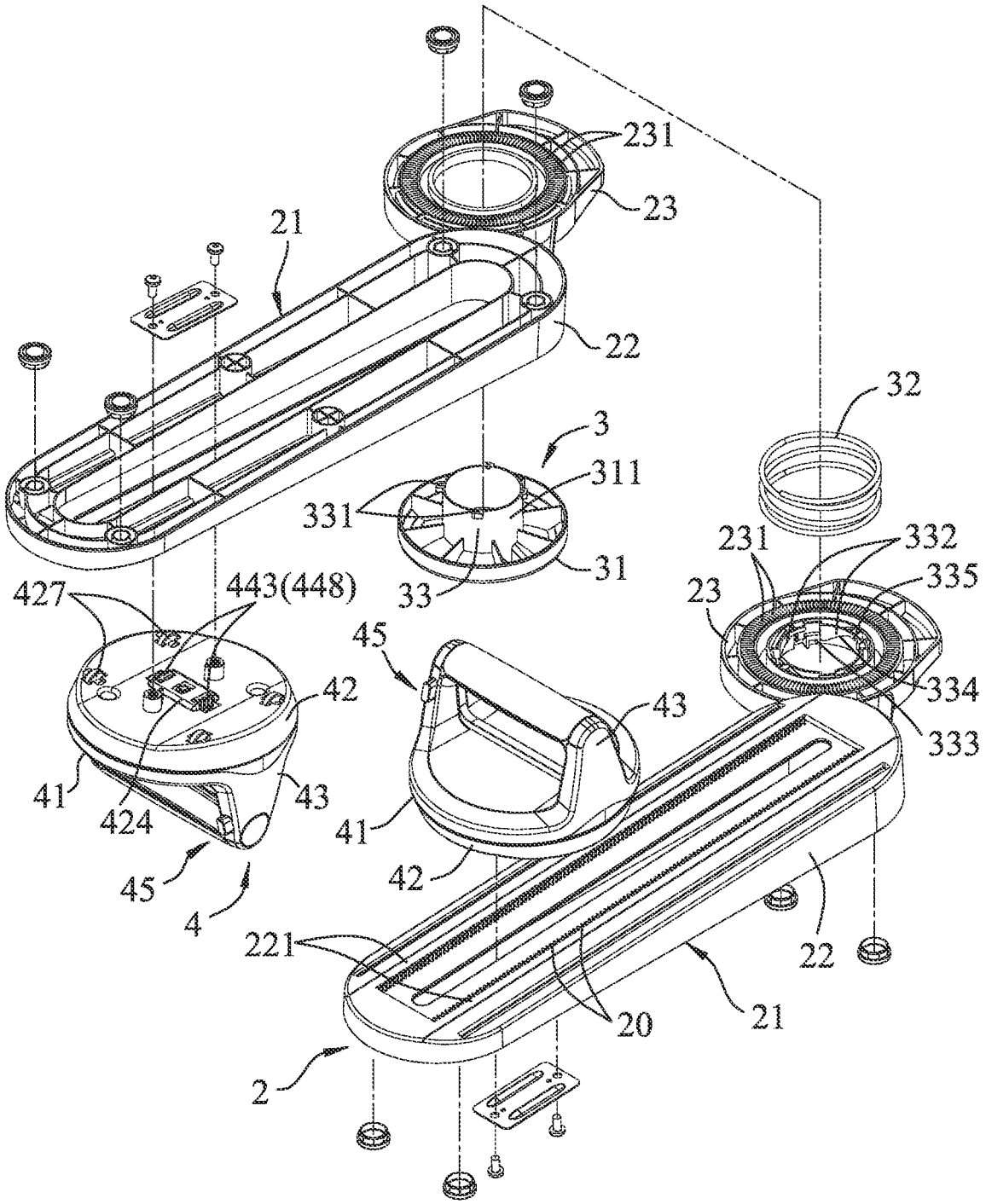
FIG. 3 is an exploded perspective view of the embodiment.
Figure 4:
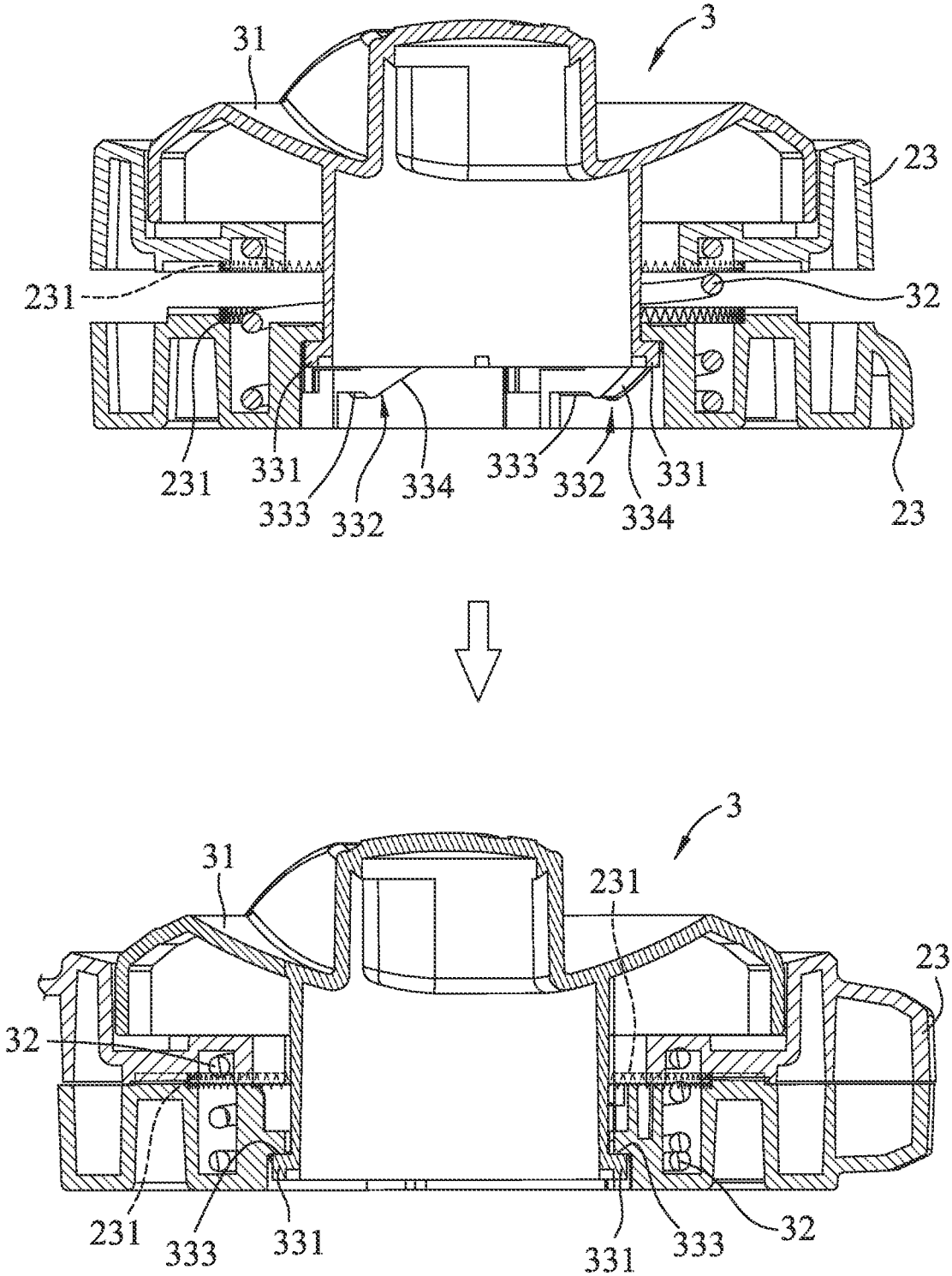
FIG. 4 is a side sectional view of the embodiment, illustrating how a retaining mechanism can be driven to drive an upper connecting seat body to move toward and engage a lower connecting seat body.
Figure 5:
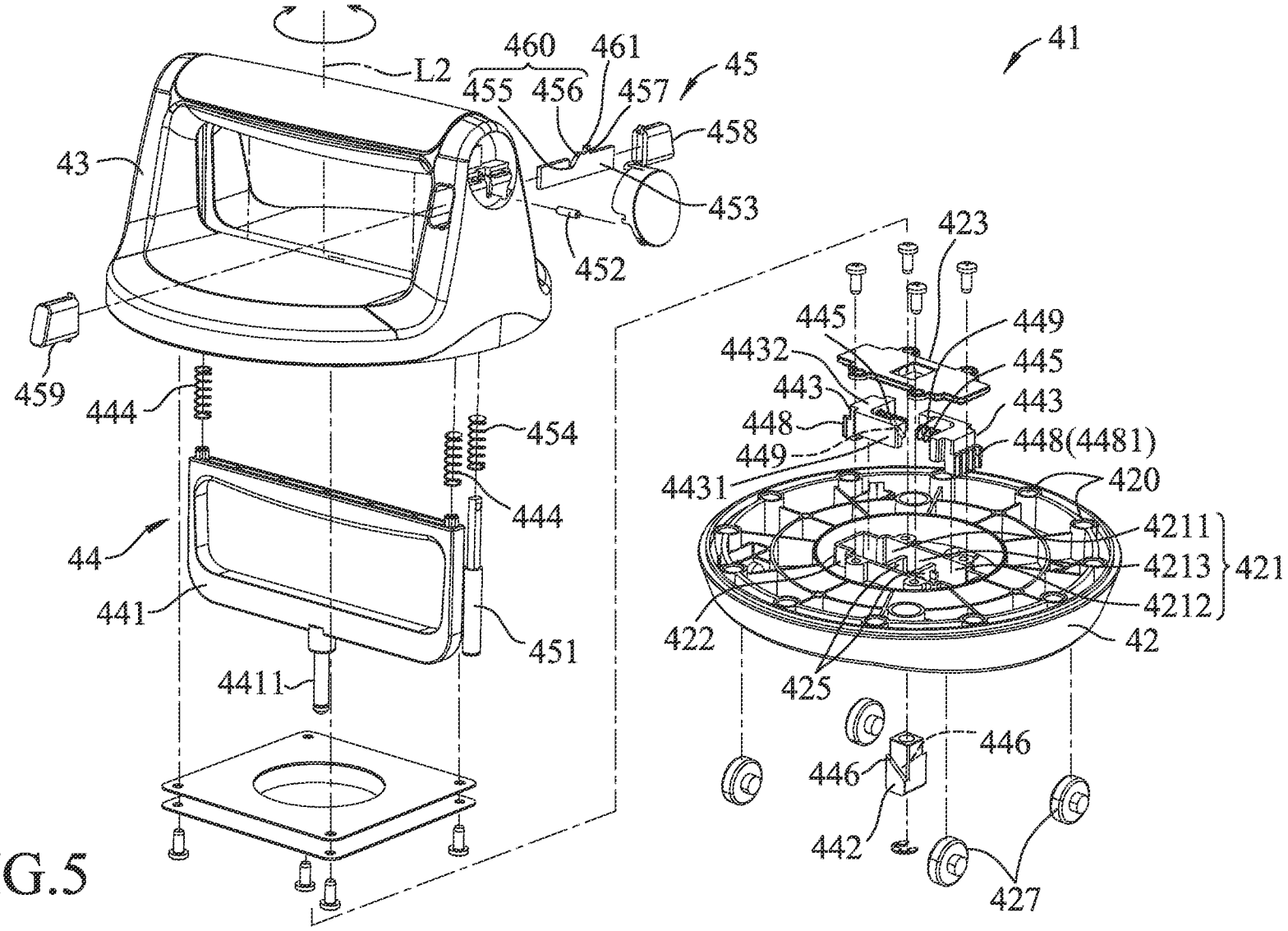
FIG. 5 is an exploded perspective view of a handgrip of the embodiment.
Figure 6:
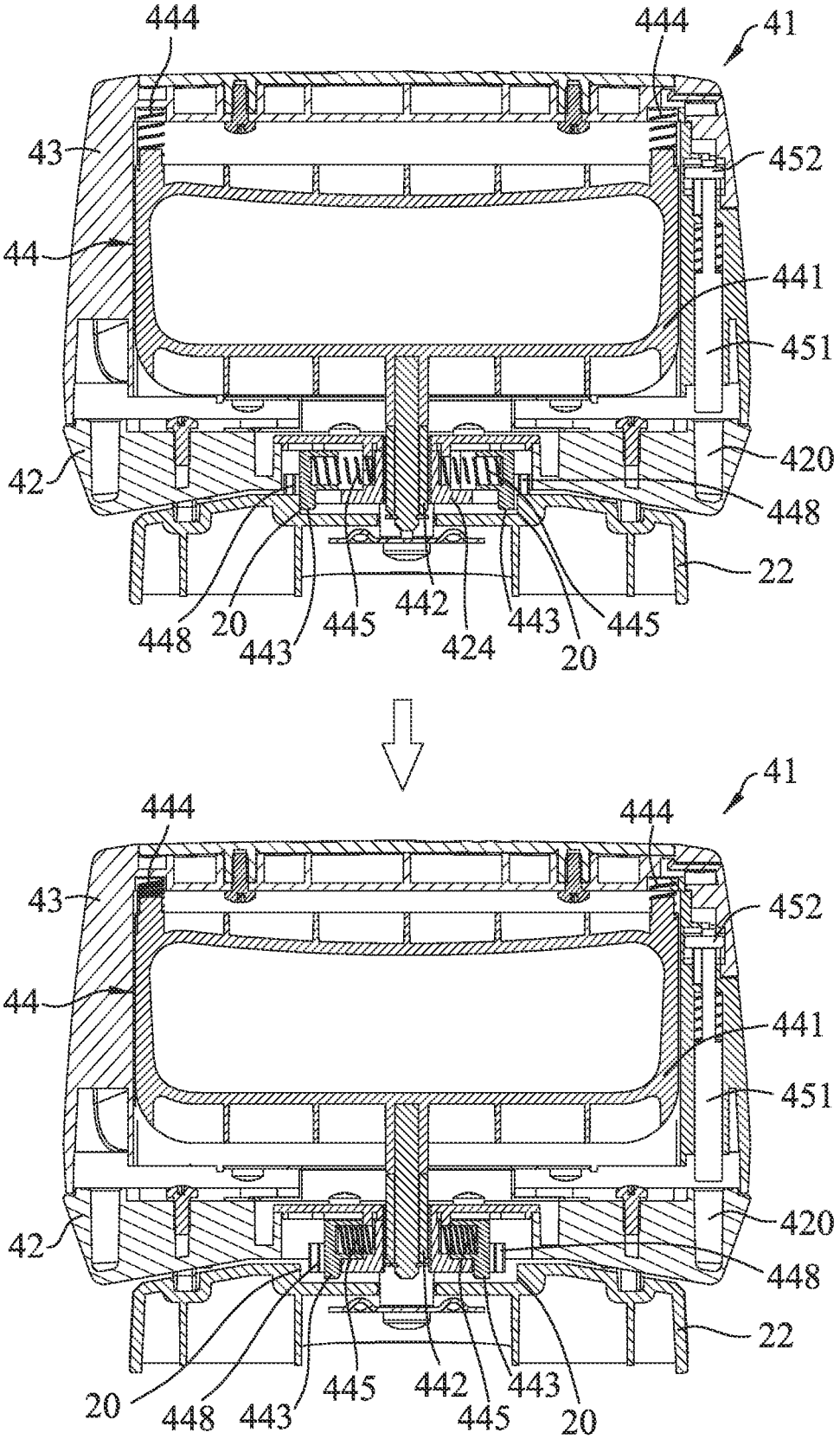
FIG. 6 is another side sectional view of the embodiment, illustrating how an engaging unit can be driven to move the handgrip from an engaging state to a disengaging state.
Figure 7:
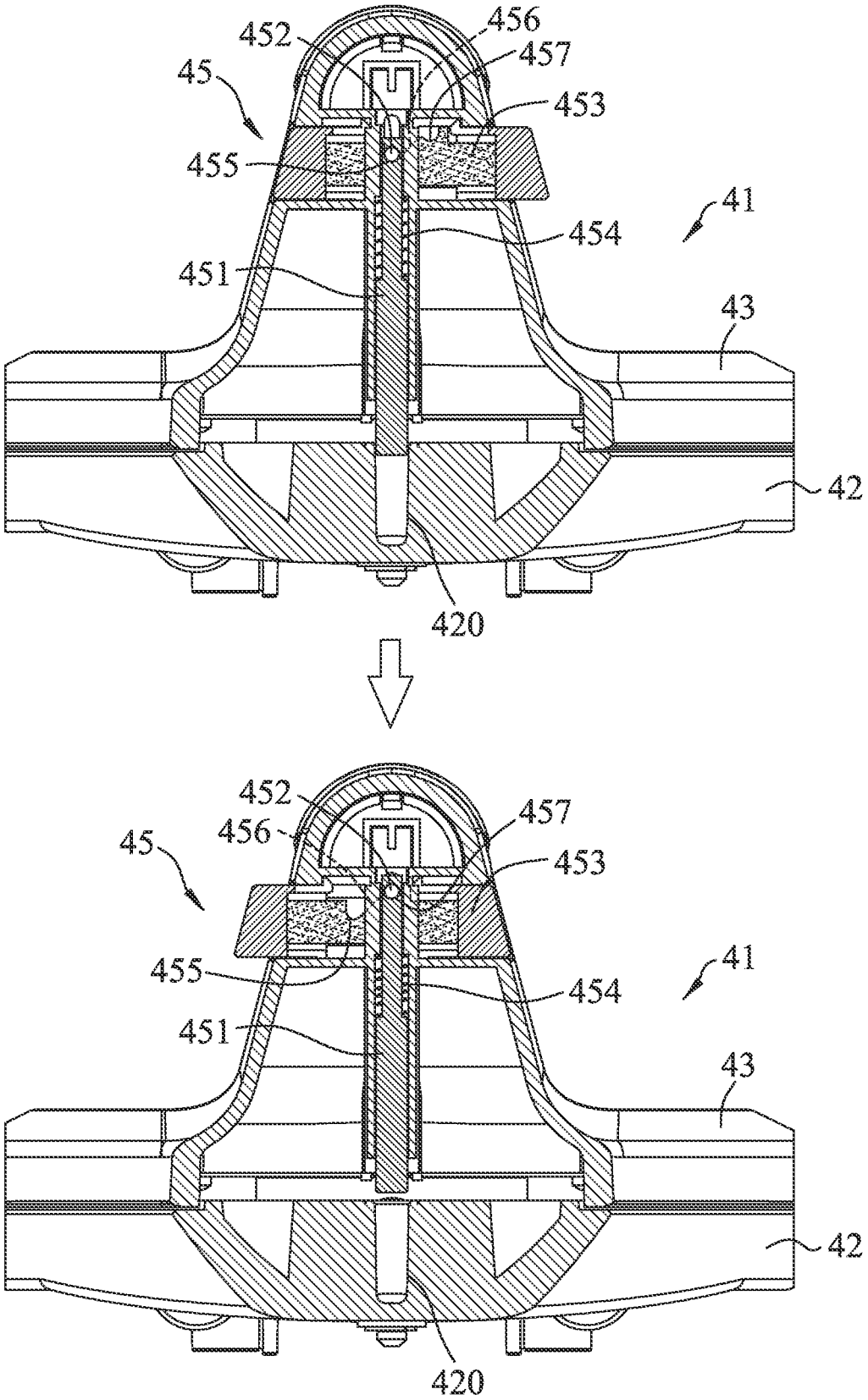
FIG. 7 is a side sectional view of an angle adjustment unit of the embodiment, illustrating how a positioning bolt can be driven to move away from a positioning groove.

Referring to FIGS. 5 to 7, in combination with FIGS. 1 and 3, the grip mechanism 4 includes two handgrips 41 respectively disposed on the base seat main bodies 22 of the base seats 21. Each handgrip 41 includes a bottom plate 42 mounted on and slidable along a length of the base seat main body 22 of a respective one of the base seats 21, a handgrip main body 43 disposed on the bottom plate 42, an engaging unit 44, and an angle adjustment unit 45. The handgrip main body 43 is rotatable relative to the bottom plate 42 about a vertical axis of rotation (L2), and is configured to be gripped by a hand of a user for driving the bottom plate 42 to slide along the length of the base seat main body 22 of the respective base seat 21.

The bottom plate 42 is slidable along the length of the base seat main body 22 through a plurality of rollers 427 provided on a bottom side thereof, and has a plurality of angularly spaced-apart positioning grooves 420 provided on an inner peripheral edge thereof and having openings that face upward, and a central receiving space 421 cooperatively defined by a substantially rectangular surrounding wall 422, an inner cover plate 423 covering one side of the central receiving space 421, and an outer cover plate 424 covering the other side of the central receiving space 421 and opposite to the inner cover plate 423. Each of the inner and outer cover plates 423, 424 has a central hole. The central receiving space 421 is divided by two partition plates 425 into three compartments, two opposite side compartments 4211, 4212 and a central compartment 4213 between the side compartments 4211, 4212.

The engaging unit 44 includes an operating member 441 mounted to an inner side of the handgrip main body 43 and having a shaft section 4411 provided on a bottom side thereof, a drive block 442 fixed to the bottom of the shaft section 4411, two driven blocks 443 spaced apart in a left-right direction and disposed movably and respectively in the side compartments 4211, 4212, two longitudinal elastic members 444, and two horizontal elastic members 445. The operating member 441 and the drive block 442 extend movably into the central compartment 4213 through the central holes of the inner and outer cover plates 423, 424. The drive block 442 has two drive surfaces 446 formed in front and rear sides thereof and inclined in opposite directions.

Each driven block 443 can be driven to move horizontally in the respective side compartment 4211 or 4212, and has a substantially L-shaped body including a first plate 4431 and a second plate 4432 transversely connected to each other. The second plate 4432 of each driven block 443 has an engaging portion 448 that is provided on an outer side thereof, that is partially exposed from a lateral side of the outer cover plate 424 (see FIGS. 3 and 6), and that includes a plurality of engaging teeth 4481 detachably meshing with corresponding ones of the teeth 20 in a respective one of the positioning portions 221. The first plate 4431 has a triangular protrusion 449 protruding inwardly from an upper corner thereof and located in the central compartment 4213. The triangular protrusion 449 has a hypotenuse portion facing the second plate 4432.

The longitudinal elastic members 444 are disposed between the handgrip main body 43 and the operating member 441 for biasing the operating member 441 to move downward relative to the handgrip main body 43.

The horizontal elastic members 445 are respectively disposed in the side compartments 44211, 4212. Each horizontal elastic member 445 has two opposite ends respectively abutting against the second plate 4432 of a respective one of the driven blocks 443 and a corresponding one of the partition plates 425 for biasing the engaging portion 448 of the second plate 4432 of the respective driven block 443 to move toward and mesh with the corresponding ones of the teeth 20 in the respective positioning portion 221.

The operating member 441 of the engaging unit 44 of each handgrip 41 is configured to be operated by the hand of the user to move up and down relative to the handgrip main body 43 and to detachably engage each handgrip 41 with the base seat main body 22 of the respective base seat 21. The drive block 442 moves up and down along with the operating member 441. Each handgrip 41 is driven by the operating member 441 to move between a disengaging state, in which the handgrip 41 is disengaged from the base seat main body 22 of the respective base seat 21 and is slidable along the length thereof, and an engaging state, in which the handgrip 41 is engaged to the base seat main body 22 of the respective base seat 21 and is positioned thereat.

In the disengaging state, the operating member 441 is moved upward and compresses the longitudinal elastic members 444 to store restoring forces, and the drive block 442 moves up along with the operating member 441 until the two drive surfaces 446 thereof respectively abut against the hypotenuse portions of the triangular protrusions 449 of the first plates 4431 of the driven blocks 443, thereby driving the driven blocks 443 to move horizontally toward each other so as to move the engaging portions 448 thereof away from the respective positioning portions 221. At this time, the horizontal elastic members 445 are compressed by the respective driven blocks 443 to store restoring forces.

In the engaging state, the operating member 441 is biased by the restoring forces of the longitudinal elastic members 444 to move downward and push the two drive surfaces 446 of the drive block 442 to respectively move away from the hypotenuse portions of the triangular protrusions 449 of the first plates 4431 of the driven blocks 443, so that the driven blocks 443 can be biased by the restoring forces of the respective horizontal elastic members 445 to move horizontally away from each other and engage the respective positioning portions 221.

The angle adjustment unit 45 includes a positioning bolt 451 disposed in the handgrip main body 43 and movable up and down relative to the same, an insertion pin 452 movably mounted to the handgrip main body 43 and connected transversely to a top end portion of the positioning bolt 451, a slide block 453 for supporting the insertion pin 452, and a second elastic member 454. The positioning bolt 451 can be driven by the insertion pin 452 to removably engage a corresponding one of the positioning grooves 420 in the bottom plate 42. The slide block 453 can be driven to move horizontally, and has a front end cap 458 sleeved on a front end thereof, a rear end cap 459 sleeved on a rear end thereof, an indented portion 460 formed between said front end and said rear end of said slide block 453 and having a lower limiting surface 455 and an adjustment inclined surface 456, an upper limiting surface 457 connected to a top end of the adjustment inclined surface 456, and a projection 461 located between the upper limiting surface 457 and the front end of the slide block 453. The second elastic member 454 is sleeved on the positioning bolt 451, and has two opposite ends respectively abutting against the handgrip main body 43 and the positioning bolt 451 for biasing the positioning bolt 451 to move downward relative to the handgrip main body 43 and engage the corresponding positioning groove 420.

To adjust an angular position of the base seats 21 relative to each other, the rotating cap 31 is rotated to drive each first retaining member 331 to move from the lower retaining surface 333 to the upper retaining surface 335 along the inclined guide surface 334 of the corresponding second retaining member 332, and the first elastic member 32 disposed between the connecting bodies 23 biases the upper connecting body 23 to move away from the lower connecting body 23. At this time, the meshing teeth 231 of the upper and lower connecting bodies 23 are separated from each other, and the base seats 21 can be pivoted about the vertical axis (L1) to a desired angular position relative to each other. Afterwards, the upper connecting body 23 is pressed downward to compress the first elastic member 32 and to move the upper connecting body 23 toward the lower connecting body 23 so as to interengage the meshing teeth 231 of the upper and lower connecting bodies 23, thereby preventing pivotal movement of the base seats 21 relative to each other about the vertical axis (L1). Then, the rotating cap 31 is rotated in a reverse direction to drive each first retaining member 331 to move from the upper retaining surface 335 to the lower retaining surface 333 along the inclined guide surface 334 of the corresponding second retaining member 332 so as to be retained thereat, thereby fixing the base seats 21 at the desired angular position relative to each other.

When the operating members 441 of the engaging units 44 of the handgrips 41 are not operated, the handgrips 41 are located in the engaging state and are fixed to the respective base seats 21. At this time, both hands of the user can respectively grip the handgrips 41, and the user can perform a push-up exercise.

When the user presses upward the operating members 441, the handgrips 41 are switched from the engaging state to the disengaging state, so that, during the push-up exercise, the handgrips 41 can slide along the lengths of the respective base seat main bodies 22. When the body of the user is raised, the handgrips 41 slide to the smallest relative distance which can stimulate the user's chest muscles to exert force inwardly and exercise the inner chest muscles and the middle chest muscles to achieve the purpose of training the chest muscles. When the body of the user is lowered, the handgrips 41 slide to the greatest relative distance which can stimulate the chest muscles to expand outwardly and train the middle chest muscles and the lower chest muscles.

The user can also push the slide block 453 of the angle adjustment unit 45 of each handgrip 41 to move rearwardly through the front end cap 458 thereof to slide the insertion pin 452 from the lower limiting surface 455 to the upper limiting surface 457 along the adjustment inclined surface 456 and abut against the projection 461 so as to drive the positioning bolt 451 to move away from the corresponding positioning groove 420. Thus, the handgrip main body 43 of each handgrip 41 can be driven by the user to rotate relative to the bottom plate 42 so as to adjust the handgrip main body 43 of each handgrip 41 to a more comfortable grip angle, after which the slide block 453 is pushed forwardly through the rear end cap 459 thereof to slide the insertion pin 452 from the upper limiting surface 457 to the lower limiting surface 455 along the adjustment inclined surface 456 and push the positioning bolt 451 to move downward and engage the corresponding positioning groove 420. As such, the handgrip main body 43 of each handgrip 41 cannot rotate relative to the bottom plate 42.

In this embodiment, the number of the retaining unit 33 is four. However, in actual practice, the number of the retaining unit 33 may be adjusted to one, two, three or more than five according to the requirements. Further, the retaining unit 33 uses the abutment of the first retaining member 331 with the second retaining member 332 to achieve the positioning thereof. However, in actual practice, the first and second retaining members 331, 332 may be screw thread, so that the retaining unit 33 may be positioned through threaded connection of the first and second retaining members 331, 332.

In summary, through the configurations of the base mechanism 2 and the retaining mechanism 3, the user can adjust and fix the base seats 21 to a desired angular position relative to each other, and can adjust the distance of the handgrips 41. Further, in coordination with the engaging units 44, the handgrips 41 can be controlled to slide along the lengths of the respective base seat main bodies 22, thereby strengthening the exercise intensity of specific areas and improving the exercise results of the chest muscles. On the other hand, the provision of the angle adjustment unit 45 can allow the user to adjust the grip angle of the handgrip 41 so as to enhance the comfort of use thereof.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A push-up exercise apparatus comprising:

a base mechanism configured for use adjacent to a floor surface and including two base seats pivotable relative to each other about a vertical axis, each of said base seats including a base seat main body, and a connecting body connected to a front side of said base seat main body, said connecting bodies of said base seats being disposed one above the other and being rotatable relative to each other about the vertical axis;

a grip mechanism including two handgrips respectively disposed on said base seats, each of said handgrips slidable along a length of said base seat main body of a respective one of said base seats; and a retaining mechanism including a rotating cap rotatably disposed on an upper one of said connecting bodies, a first elastic member disposed between said connecting bodies, and at least one retaining unit that includes a first retaining member and a second retaining member respectively disposed on said rotating cap and a lower one of said connecting bodies and engaged with each other, said rotating cap being rotated to drive said first retaining member to move relative to said second retaining member, thereby driving said connecting bodies toward and away from each other, said connecting bodies being engaged with each other when driven toward each other so as to fix said base seats in an angular position relative to each other.

2. The push-up exercise apparatus as claimed in claim 1, wherein said second retaining member has a lower retaining surface extending horizontally and facing downwardly, and an inclined guide surface that extends upwardly and inclinedly from said lower retaining surface and that faces downwardly, said first retaining member being driven by said rotating cap to move along said inclined guide surface to said lower retaining surface.

3. The push-up exercise apparatus as claimed in claim 2, wherein said second retaining member further has an upper retaining surface that extends horizontally, that faces downwardly, that is connected to a top end of said inclined guide surface and that is opposite to said lower retaining surface, said first retaining member being driven by said rotating cap to move from said lower retaining surface to said upper retaining surface along said inclined guide surface.

4. The push-up exercise apparatus as claimed in claim 1, wherein said connecting bodies have inner surfaces facing each other and respectively provided with a plurality of meshing teeth surrounding the vertical axis, and wherein, when said connecting bodies are driven by said retaining mechanism to move toward each other, said plurality of meshing teeth of said connecting bodies are inter-engaged to prevent pivotal movement of said base seats relative to each other about the vertical axis.

5. The push-up exercise apparatus as claimed in claim 1, wherein:

said base seat main body of each of said base seats is elongated; each of said handgrips includes a bottom plate mounted on and slidable along the length of said base seat main body of the respective one of said base seats, a handgrip main body disposed on said bottom plate, and an engaging unit disposed between said handgrip main body and said bottom plate;

said handgrip main body of each of said handgrips is configured to be gripped by a hand of a user for driving said bottom plate to slide along the length of said base seat main body of the respective one of said base seats;

said engaging unit of each of said handgrips is configured to be operated by the hand of the user to detachably engage each of said handgrips with said base seat main body of the respective one of said base seats; and said engaging unit of each of said handgrips can be driven to change each of said handgrips to move between a disengaging state that allows each of said handgrips to slide relative to said base seat main body of the respective one of said base seats and an engaging state that allows each of said handgrips to engage and be positioned in said base seat main body of the respective one of said base seats.

6. The push-up exercise apparatus as claimed in claim 5, wherein:

said base seat main body of each of said base seats has at least one positioning portion extending along the length thereof;

said engaging unit of each of said handgrips includes an operating member disposed within said handgrip main body and extending to said bottom plate, a drive block connected to a bottom portion of said operating member, and at least one driven block that is disposed horizontally and movably in said bottom plate, that is exposed from a bottom side of said bottom plate and that is abuttable against said drive block; and said operating member of each of said handgrips can be operated to move up and down relative to said handgrip main body so as to drive said drive block, which in turn, drives said at least one driven block to move horizontally away from and toward said at least one positioning portion.

7. The push-up exercise apparatus as claimed in claim 6, wherein:

said at least one positioning portion has a plurality of teeth formed along a length thereof;

said drive block has at least one drive surface formed inclinedly on one side thereof;

said at least one driven block has at least one engaging portion detachably engageable with corresponding said plurality of teeth, and at least one driven inclined surface abutting against said at least one drive surface; and said engaging unit further includes at least one horizontal elastic member disposed between said at least one driven block and said bottom plate for forcing said at least one engaging portion of said at least one driven block to move toward and engage the corresponding said plurality of teeth.

8. The push-up exercise apparatus as claimed in claim 7, wherein a number of said at least one positioning portion, said at least one drive surface, said at least one driven block, said at least one engaging portion, said at least one driven inclined surface and said at least one horizontal elastic member is two.

9. The push-up exercise apparatus as claimed in claim 7, wherein said engaging unit of each of said handgrips further includes two longitudinal elastic members disposed between said handgrip main body and said operating member for biasing said operating member to move downward relative to said handgrip main body.

10. The push-up exercise apparatus as claimed in claim 5, wherein:

said handgrip main body is rotatable relative to said bottom plate about a vertical axis of rotation;

said bottom plate has a plurality of angularly spaced-apart positioning grooves that have openings facing upward and that surround the vertical axis of rotation;

each of said handgrips further includes an angle adjustment unit mounted on said handgrip main body, said angle adjustment unit including a positioning bolt slidably disposed in said handgrip main body and movable up and down relative to said handgrip main body, an insertion pin movably mounted to said handgrip main body and connected transversely to said positioning bolt, a slide block for abutment of said insertion pin therewith, and a second elastic member disposed between said handgrip main body and said positioning bolt for forcing said positioning bolt to move downward relative to said handgrip main body, said slide block having an adjustment inclined surface extending upwardly and inclinedly, a lower limiting surface connected to a bottom end of said adjustment inclined surface and an upper limiting surface connected to a top end of said adjustment inclined surface; and said slide block can be driven to move horizontally with said adjustment inclined surface driving said insertion pin to slide upward relative to said handgrip main body to said upper limiting surface and drive said positioning bolt to move upward and disengage from a corresponding one of said plurality of angularly spaced-apart positioning grooves, or to slide downward to said lower limiting surface and drive said positioning bolt to move downward and engage the corresponding one of said plurality of angularly spaced-apart positioning grooves.

* * * * *